US005297593A

United States Patent [19]

Holzman

[11] Patent Number: 5,297,593

[45] Date of Patent: Mar. 29, 1994

[54] STEEL LINE CLOSED LOOP FORMING TOOL

[76] Inventor: Robert P. Holzman, 4550 NE. Campaign St., Portland, Oreg. 97218

[21] Appl. No.: 14,755

[22] Filed: Feb. 8, 1993

[51] Int. Cl.[5] ..... B21F 1/06

[52] U.S. Cl. ..... 140/104

[58] Field of Search ..... 140/102, 102.5, 104; 211/DIG. 1; 248/309.4

[56] References Cited

U.S. PATENT DOCUMENTS 83,522 10/1868 Miller ..... 140/104
2,683,306 7/1954 Brignall ..... 140/102
3,340,905 9/1967 Yust ..... 140/104
5,056,661 10/1991 Balzano ..... 211/DIG. 1

*Primary Examiner*—Lowell A. Larson
*Attorney, Agent, or Firm*—Leon Gilden

[57] ABSTRACT

A tool member having a rigid U-shaped frame includes a first crank arm cooperative with a plurality of guide posts, and an L-shaped bending arm to effect bending of a metallic wire member into a first loop, with a second crank arm cooperative with the U-shaped frame and a plate member to effect winding of the metallic wire in a spiral relationship to effect securement of the loop relative to the wire member.

1 Claim, 4 Drawing Sheets

STEEL LINE CLOSED LOOP FORMING TOOL

BACKGROUND OF THE INVENTION

1. Field of the Invention

The field of invention relates to wire bending apparatus, and more particularly pertains to a new and improved steel line closed loop forming tool wherein the same is arranged for the ease of loop forming of a wire member relative to the use in stainless-wire type fishing line components.

2. Description of the Prior Art

Wire bending structure of various types have been utilized in the prior art, wherein U.S. Pat. No. 3,847,189 to Guzda sets forth a wire cutting and bending tool arranged to effect the initial bending and then severing of wire to form a loop configuration.

Wire bending tools are further exemplified in the U.S. Pat. Nos. 4,331,183 and 3,612,114.

The instant invention attempts to overcome deficiencies of the prior art by providing for a tool structure to provide for the forming of fishing tackle loops to provide for initial bending and winding of the line about the loop to provide for a fixed loop structure and in this respect, the present invention substantially fulfills this need.

SUMMARY OF THE INVENTION

In view of the foregoing disadvantages inherent in the known types of wire bending apparatus now present in the prior art, the present invention provides a steel line closed loop forming tool wherein the same is arranged in a multi-station construction to provide for initial bending and then spiral winding of a steel wire to form a loop configuration. As such, the general purpose of the present invention, which will be described subsequently in greater detail, is to provide a new and improved steel line closed loop forming tool which has all the advantages of the prior art wire bending tool structure and none of the disadvantages.

To attain this, the present invention provides a tool member having a rigid U-shaped frame, including a first crank arm cooperative with a plurality of guide posts, and an L-shaped bending arm to effect bending of a metallic wire member into a first loop, with a second crank arm cooperative with the U-shaped frame and a plate member to effect winding of the metallic wire in a spiral relationship to effect securement of the loop relative to the wire member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved steel line closed loop forming tool which has all the advantages of the prior art wire bending apparatus and none of the disadvantages.

It is another object of the present invention to provide a new and improved steel line closed loop forming tool which may be easily and efficiently manufactured and marketed.

It is a further object of the present invention to provide a new and improved steel line closed loop forming tool which is of a durable and reliable construction.

An even further object of the present invention is to provide a new and improved steel line closed loop forming tool which is susceptible of a low cost of manufacture with regard to both materials and labor, and which accordingly is then susceptible of low prices of sale to the consuming public, thereby making such steel line closed loop forming tool economically available to the buying public.

Still yet another object of the present invention is to provide a new and improved steel line closed loop forming tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
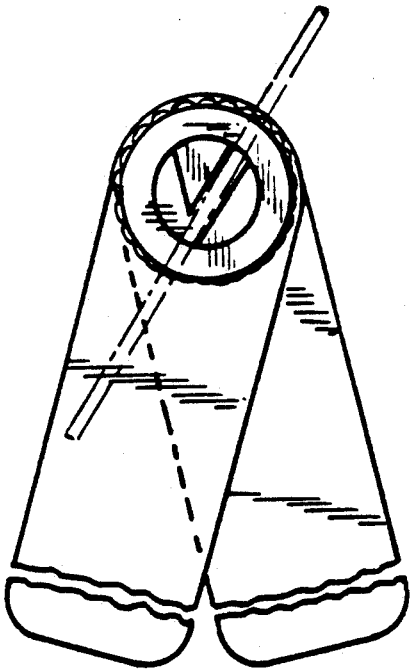
FIG. 1 is an orthographic view of a prior art wire bending structure.
Figure 2:
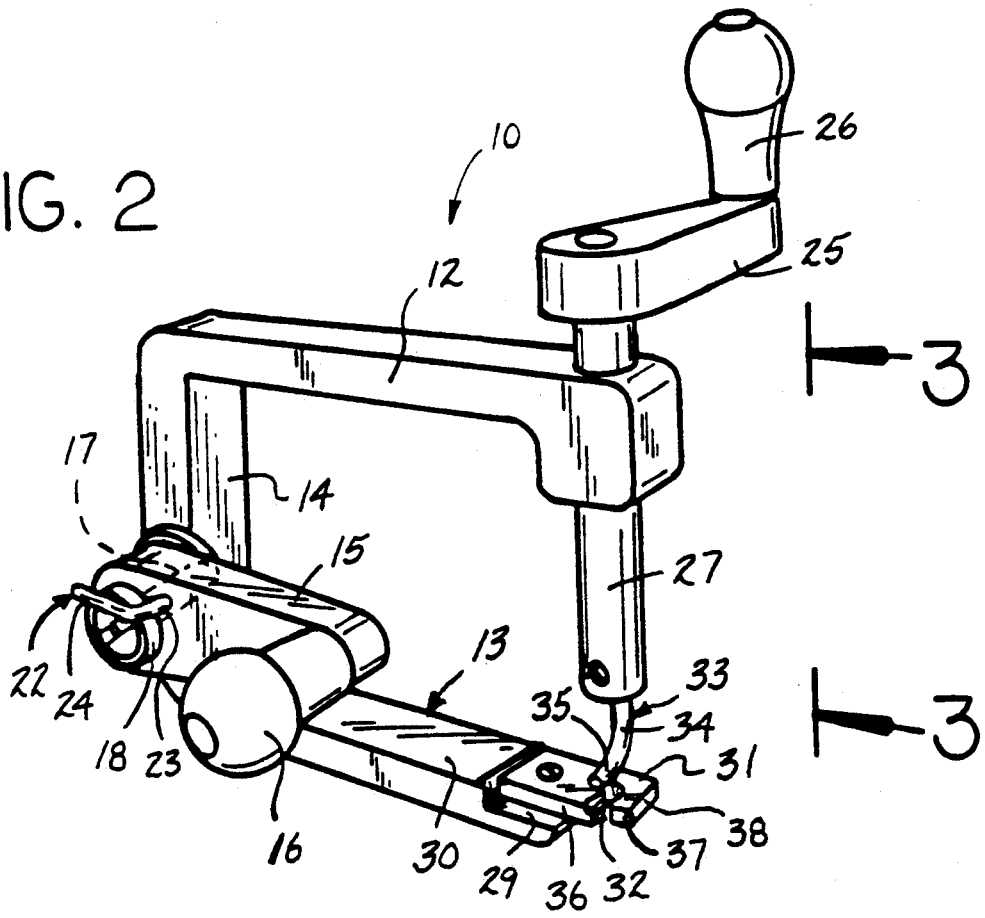
PRIOR ART FIG. 2
FIG. 2 is an isometric illustration of the invention.
Figure 3:
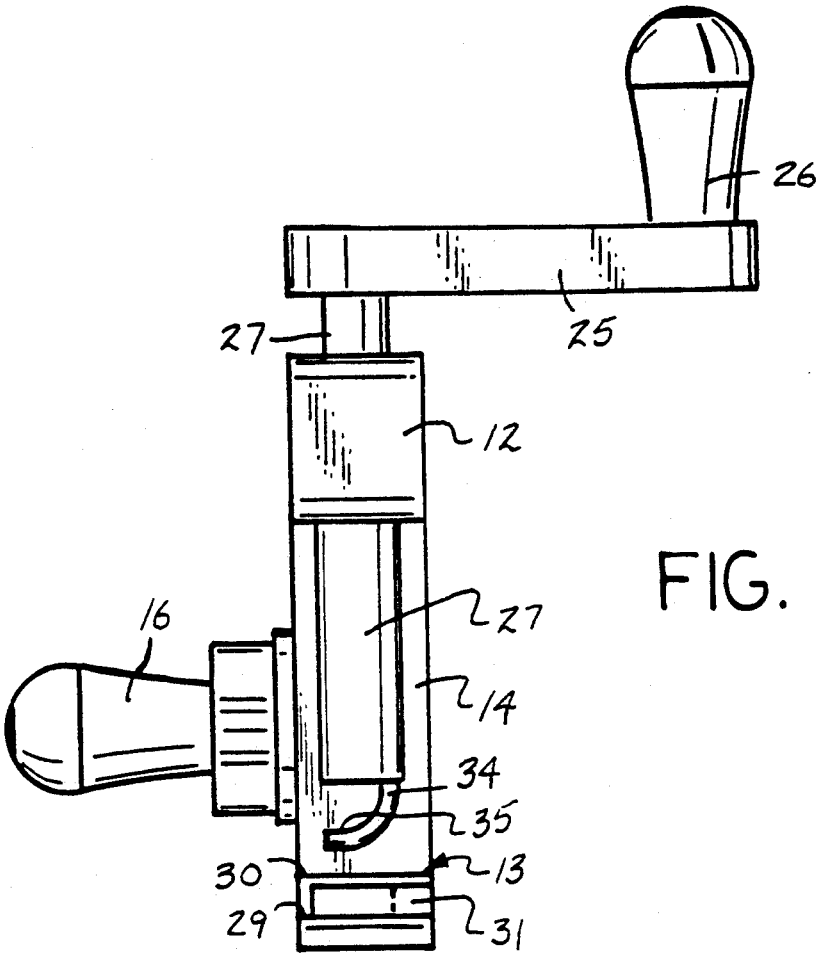
FIG. 3 is an orthographic view, taken along the lines 3—3 of FIG. 2 in the direction indicated by the arrows.
Figure 4:
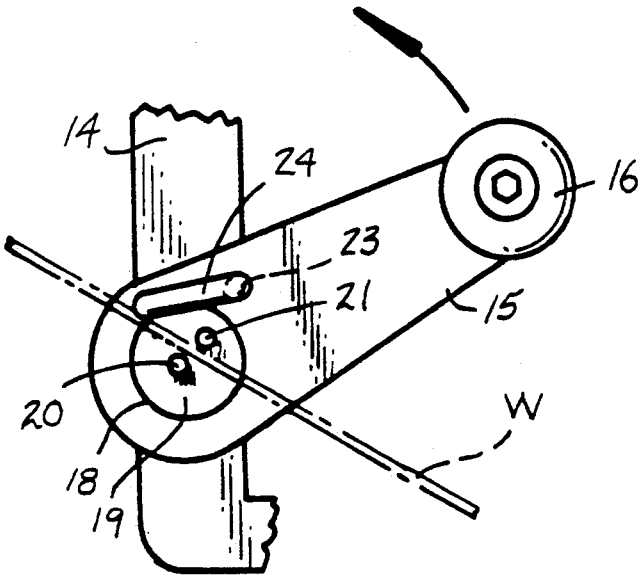
FIG. 4 is an orthographic view of the first crank structure employed by the invention.

With reference now to the drawings, and in particular to FIGS. 1 to 9 thereof, a new and improved steel line closed loop forming tool embodying the principles and concepts of the present invention and generally designated by the reference numeral 10 will be described.

FIG. 1 indicates a prior art bending tool to perform bending of wire structure, as indicated in U.S. Pat. No. 3,847,189.

Figure 5:
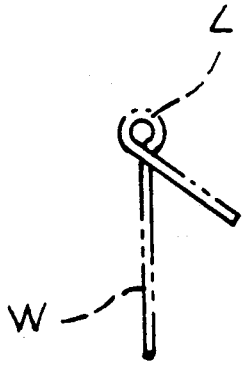
FIG. 5 is an orthographic view of a wire workpiece subsequent to the first work station as set forth in FIG. 4.
Figure 6:
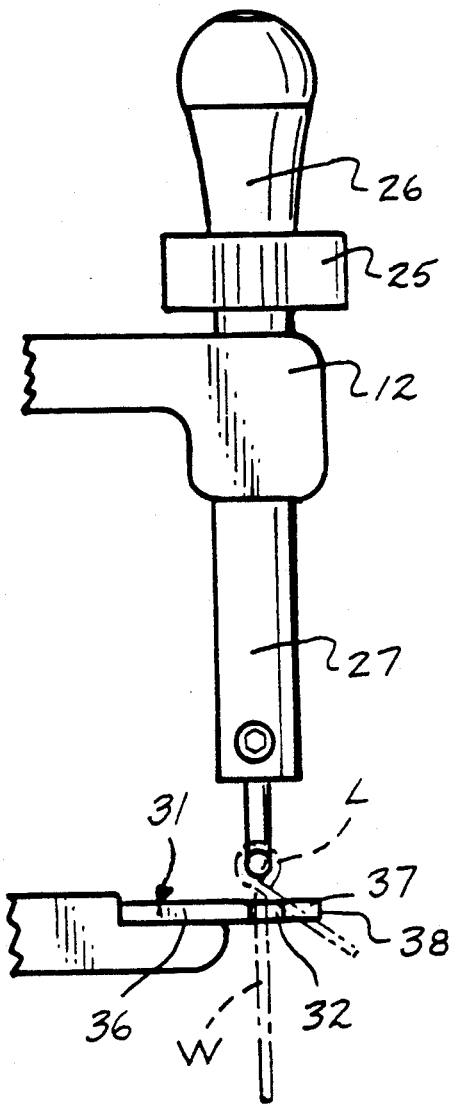
FIG. 6 is an orthographic view of the second crank structure at the second work station.
Figure 7:
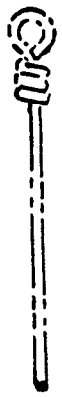
FIG. 7 is an orthographic view of the workpiece subsequent to its deformation at the second work station as set forth in FIG. 6.

The steel line closed loop forming tool 10 of the invention essentially comprises a U-shaped frame 11 having a first frame leg 12 spaced from and parallel a second frame leg 13, with a connecting web 14 orthogonally interconnecting the first and second frame legs 12 and 13. A first crank arm 15 is rotatably mounted about the connecting web 14 about a first crank arm fixed axle 17 orthogonally directed into the first crank arm 15. A first crank arm handle 16 rotatably mounted relative to the first crank arm 15 at a free distal end of the crank arm is orthogonally oriented relative to the first crank arm 15 for its rotation about the first crank arm fixed axle 17. A fixed axle shaft hub 18 extends axially beyond the first crank arm 15 terminating in a planar end wall 19 that is orthogonally oriented relative to the axle shaft 17. Respective first and second guide pins 20 and 21 are fixedly and orthogonally mounted to the planar end wall 19 arranged parallel relative to one another. An L-shaped bending arm 22 is fixedly mounted to the first crank arm 15 adjacent the hub 18, having a bending arm first leg 23 oriented parallel to the first and second guide pins 20 and 21 and spaced therefrom and positioned adjacent the fixed axle shaft hub 18. The L-shaped bending arm 22 includes a second leg 24 orthogonally oriented relative to the first leg 23 and extending over the planar end wall 19 spaced from the first and second guide pins 20 and 21 to thereby receive a wire member "W" (see FIG. 4) between the guide pins 20 and 21 and within the L-shaped bending arm 22 to effect bending the wire "W" to form a loop "L", as illustrated in FIG. 5. A second crank arm 25 is provided, having a second crank arm handle 26 rotatably mounted relative to the second crank arm 25 orthogonally oriented thereto, with the second crank arm 25 having a second crank arm axle shaft 27 orthogonally directed through the first frame leg 12, with the second crank arm axle shaft 27 oriented parallel to the second crank arm handle 26. The second frame leg 13 includes second frame leg free end 28 positioned below the second crank arm axle shaft 27, having a second frame leg recess floor 29 spaced below a second frame leg interior wall 30, that in turn is in facing relationship relative to the first frame leg 12. An alignment plate 31 is mounted upon the recess floor 29, having an alignment plate groove 32 positioned below and orthogonally oriented relative to the second crank arm axle shaft 27. The alignment plate 31 includes an alignment plate first side wall portion 36 on a first side of the groove extending from the groove 32 to the second frame leg interior wall 30, with a side wall second portion 37 positioned on an opposed side of the groove extending to an alignment plate front end wall 38. The second crank arm axle shaft 27 includes an L-shaped mounting rod 33 having a mounting rod first leg 34 coaxially aligned with the second crank arm axle shaft 27, with a mounting rod second leg 35 orthogonally oriented relative to the mounting rod first leg, with the second leg 35 receiving a loop "L" thereabout and the workpiece "W" positioned within the groove 32, whereupon rotation of the L-shaped mounting rod 33 having the bent portion of the wire "W" extending from the loop imposed upon the side wall second portion 37 and upon rotation of the L-shaped mounting rod 33 effecting a winding of the wire "W" about the body, in a manner as indicated in FIG. 7.

Figure 8:
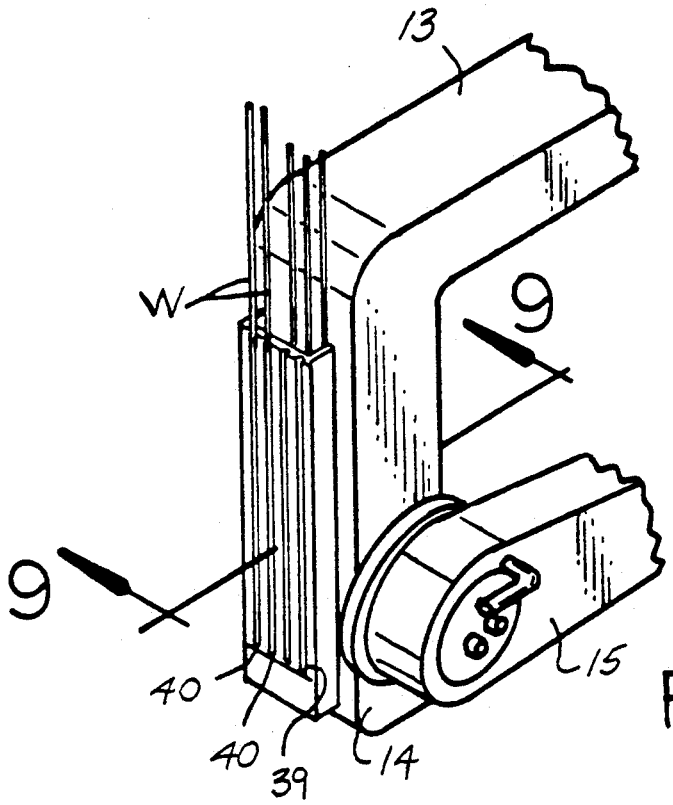
FIG. 8 is an isometric illustration of the invention utilizing a magnetic holder structure.
Figure 9:
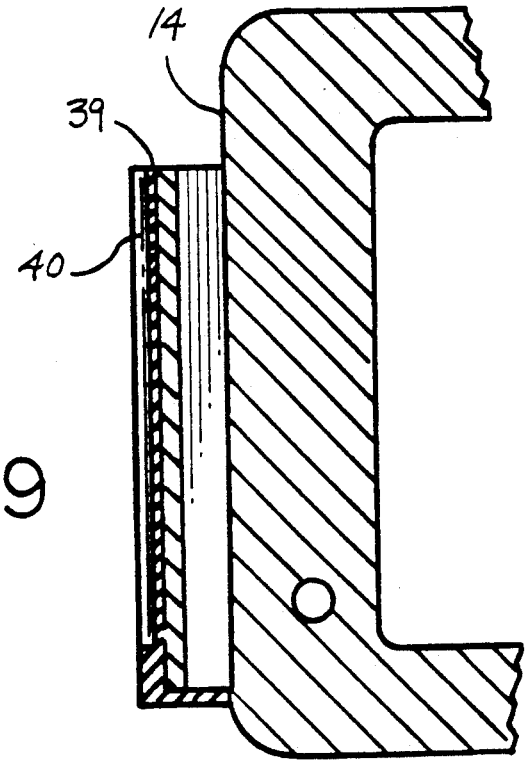
FIG. 9 is an orthographic view, taken along the lines 9—9 of FIG. 8 in the direction indicated by the arrows.

The FIGS. 8 and 9 indicate the use of a storage plate 39 mounted to the connecting web 14, having a storage plate plurality of parallel storage plate grooves 40 each arranged to receive a wire "W" therewithin for storage for subsequent use into forming the wires "W" into lead lines and the like for use in a fishing environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A steel line closed loop forming tool, comprising, a frame member, the frame member including a first frame leg, a second frame leg, and a connecting web extending between the first frame leg and the second frame leg, and a first crank arm mounted to the connecting web, wherein the first crank arm has a first handle rotatably and orthogonally mounted relative to the first crank arm, and a first axle shaft orthogonally mounted to the connecting web mounting the first crank arm in a spaced relationship relative to the first handle, with the first handle parallel to the first axle shaft, and the first axle shaft including a fixed hub extending axially beyond the first crank arm terminating in a planar end wall, with the planar end wall including a first guide pin and a second guide pin arranged in a parallel relationship relative to one another and orthogonally oriented relative to the planar end wall, and arm means mounted to the first crank arm to effect bending of a wire workpiece directed between the first guide pin and the second guide pin, and the arm means includes an L-shaped bending arm, having a first leg fixedly and orthogonally mounted to the first crank arm in adjacency to the planar end wall, and the L-shaped bending arm including a second leg orthogonally mounted to the first leg, wherein the second leg is oriented parallel and over the planar end wall in spaced adjacency to the first guide pin and the second guide pin to receive the wire member within the first leg and second leg and bend the wire member into a loop about the first guide pin, and a second crank arm, the second crank arm including a second handle orthogonally and rotatably mounted to the second crank arm and a second axle shaft orthogonally mounted to the second crank arm parallel to the second handle, with the second axle shaft extending orthogonally through the first frame leg in a spaced orientation relative to the second frame leg orthogonally oriented relative to the second frame leg, and to a second frame leg interior wall that is in facing relationship relative to the first frame leg, and the second frame leg interior wall including a recess floor at a free distal end of the second frame leg spaced from the second frame leg interior wall, wherein the recess floor includes an alignment plate fixedly mounted to the recess floor, and the alignment plate includes an alignment plate groove arranged to receive the metallic wire therewithin, and the second axle shaft having an L-shaped mounting rod, the L-shaped mounting rod including a mounting rod first leg coaxially aligned with and fixedly mounted to the second axle shaft at a free distal end of the second axle shaft spaced from the first frame leg between the first frame leg and the alignment plate, and a mounting rod second leg orthogonally and fixedly mounted to the first leg arranged to receive the loop thereabout, and the alignment plate having a first side wall portion extending from the groove to the second frame leg interior wall, and a side wall second portion extending from the groove to a front end wall portion of the alignment plate spaced from the second frame leg, wherein the side wall second portion is arranged to provide abutment for the wire member extending from the loop, and a storage plate mounted to the connecting web, wherein the storage plate includes a plurality of parallel grooves, and the storage plate formed of a ferrous magnetic material arranged to secure a plurality of further wire members within the grooves.

* * * * *